US007105035B2

(12) United States Patent
Oh et al.

(10) Patent No.: US 7,105,035 B2
(45) Date of Patent: Sep. 12, 2006

(54) CYCLONE-TYPE DUST COLLECTING APPARATUS FOR VACUUM CLEANER

(75) Inventors: Jang-Keun Oh, Gwangju (KR); Hyoung-Jong Jin, Gwangju (KR)

(73) Assignee: Samsung Gwangju Electronics Co., Ltd., Gwangju (KR)

( * ) Notice: Subject to any disclaimer, the term of this patent is extended or adjusted under 35 U.S.C. 154(b) by 448 days.

(21) Appl. No.: 10/620,892

(22) Filed: Jul. 16, 2003

(65) Prior Publication Data

US 2004/0200028 A1 Oct. 14, 2004

(30) Foreign Application Priority Data

Apr. 11, 2003 (KR) ..... 10-2003-0022878

(51) Int. Cl.
*B01D 45/12* (2006.01)

(52) U.S. Cl. ..... 55/337; 55/429; 55/459.1; 55/481; 55/DIG. 3

(58) Field of Classification Search ..... 55/337, 55/429, 459.1, 481, 502, 503, DIG. 3; 15/350, 15/353
See application file for complete search history.

(56) References Cited

U.S. PATENT DOCUMENTS 6,269,518 B1 8/2001 Yung ..... 15/352
6,648,934 B1 * 11/2003 Choi et al. ..... 55/337
6,810,557 B1 * 11/2004 Hansen et al. ..... 15/353
2003/0066273 A1 4/2003 Choi et al. ..... 55/337

FOREIGN PATENT DOCUMENTS

| | | |
|---|---|---|
| GB | 2389034 A | 12/2003 |
| WO | WO 02/078505 | 10/2002 |
| WO | WO 02/078506 | 10/2002 |
| WO | WO02078506 | 10/2002 |

OTHER PUBLICATIONS

Great Britain Search Report Application No. 0317873.8, dated Jan. 26, 2004.
Canadian Office Action dated Aug. 17, 2005 in connection to corresponding Application No. 2,448,036.

* cited by examiner

*Primary Examiner*—Robert A. Hopkins
(74) *Attorney, Agent, or Firm*—Ohlandt, Greeley, Ruggiero & Perle, L.L.P.

(57) ABSTRACT

A cyclone-type dust collecting apparatus for a vacuum cleaner is provided. The apparatus comprises a cyclone body having an air inlet port and an air outlet port, for forming a vortex current of air which is introduced through the air inlet port and contains dust; a dust collecting container removably coupled to the cyclone body so as to collect the dust separated by centrifugal force of the vortex current in the cyclone body; a grill disposed at an upstream portion of the air outlet port in the cyclone body to prevent dust separated from the air from flowing back through the air outlet part; and a fine dust filtering means disposed at a downstream portion of the grill in the cyclone body to collect fine dust which passes through the grill.

6 Claims, 8 Drawing Sheets

CYCLONE-TYPE DUST COLLECTING APPARATUS FOR VACUUM CLEANER

BACKGROUND OF THE INVENTION

1. Field of the Invention

The present invention relates to a cyclone-type dust collecting apparatus, and more particularly, to a cyclone-type dust collecting apparatus for an upright vacuum cleaner, which allows air containing various dusts and foreign substances (hereinafter, called "dust") to form a vortex current, thereby collecting the dust from the vortex current of air by centrifugal force.

2. Description of the Related Art

FIGS. 1 and 2 schematically show an example of a typical cyclone-type dust collecting apparatus for a vacuum cleaner.

As shown in FIGS. 1 and 2, the cyclone-type dust collecting apparatus 100 for the vacuum cleaner generally comprises a cyclone body 10, a dust collecting container 20 and a grill 30.

The cyclone body 10 is provided with an air inlet port 11 and an air outlet portion 12. The air inlet port 11 is connected to a side of the cyclone body 10, and the air outlet port 12 is connected with a center portion of an upper face of the cyclone body 10. Herein, when the cyclone-type dust collecting apparatus 100 is disposed in a main body 200 of the vacuum cleaner, the air inlet port 11 is connected to an air inlet path 210 which is disposed at the main body 200 of the vacuum cleaner to be communicated with a suction brush 300, and the air outlet port 12 is connected to an air outlet path 220 which is disposed at the main body 200 of the vacuum cleaner to be communicated with a motor driving chamber 310. Therefore, the air introduced through a suction brush 300 and containing the dust is introduced through the air inlet path 210 of the main body 200 of the vacuum cleaner and the air inlet port 11 into the cyclone body 10 in the tangential direction. Thus, a vortex current of air is formed in the cyclone body 10, and the dust contained in the vortex current is separated by centrifugal force, and then the clean air is exhausted through the air outlet port 12, the air outlet path 220 of the main body 200 of the vacuum cleaner and a motor driving chamber 310.

The dust collecting container 20 is removably coupled to a lower portion of the cyclone body 10 so as to collect the dust separated from the air by the vortex current.

The grill 30 is disposed at an entrance of the air outlet port 12 in the cyclone body 10 so that the dust separated from the vortex current dose not flow backward through the air outlet port 12. The grill 30 is provided with a grill body 31 and a plurality of paths 32 formed at an outer surface of the grill body so as to be communicated with the air outlet port 12. Further, the grill 30 has a dust preventing member 33 disposed at a lower portion of the grill body 31.

The conventional cyclone-type dust collecting apparatus as described above is mounted in the dust chamber 230 of the main body 200 of the vacuum cleaner so that the air inlet port 11 and the air outlet port 12 of the cyclone body 10 are connected to the air inlet path 210 and the air outlet path 220 of the main body 200 of the vacuum cleaner.

When starting a cleaning operation, a suction force is generated at the suction brush 300 due to driving of a motor in the motor driving chamber 310. Then, the air containing the dust on a surface of an object to be cleaned is introduced through the suction brush 300, the air inlet path 210 and the air inlet port 11 into the cyclone body 10 due to the suction force. At this time, the introduced air is induced from the air inlet port 11 along an internal interference of the cyclone body 10 in an oblique direction, thereby forming the vortex current of air. Therefore, the dust contained in the air is separated by the centrifugal force and collected in the dust collecting container 20. Then, the purified air is exhausted through the path 32 of the grill 30, the air outlet port 12, the air outlet path 220 and the motor driving chamber 310 to the outside.

However, in the conventional cyclone-type dust collecting apparatus as described above, there is a problem that the fine dust which is smaller than a size of the path 33 of the grill 30 is flown back through the path 33 of the grill 30 together with the air, deteriorating a dust collecting efficiency.

SUMMARY OF THE INVENTION

Therefore, it is an object of the present invention to provide a cyclone-type dust collecting apparatus for a vacuum cleaner, which can filter and collect fine dust contained in air which is exhausted through a path of a grill, thereby preventing a backflow of the fine dust.

To achieve an object of the present invention, there is provided a cyclone-type dust collecting apparatus for a vacuum cleaner, comprising a cyclone body having an air inlet port and an air outlet port, for forming a vortex current of air which is introduced through the air inlet port and contains dust; a dust collecting container removably coupled to the cyclone body so as to coiled the dust separated by centrifugal force of the vortex current in the cyclone body; a grill disposed at an upstream portion of the air outlet port in the cyclone body to prevent dust separated from the air from flowing back through the air outlet port; and a fine dust filtering means disposed at a downstream portion of the grill in the cyclone body to collect fine dust which passes through the grill.

Preferably, the cyclone body comprises a vortex current chamber formed with the air inlet port, a pressure drop chamber formed with the air outlet port, and also a path forming member for forming an air outlet guiding path by which the air containing the fine dust passing through the grill is flown from an upstream portion toward a downstream portion of the fine dust filtering means and then exhausted through the air outlet port.

Preferably, the fine dust filtering means comprises a filter mounting portion formed at an upper side of the path forming member and having a front opening and a plurality of upper and lower through holes for communicating the air outlet guiding path and the air outlet port; and a filter assembly detachably coupled to the filter mounting portion in a drawer way.

Further, the filter assembly comprises a filter case having a shape corresponding to a size and a structure of the filter mounting portion; and a fine filter disposed at the filter case.

Furthermore, the fine filter may be formed of sponge, etc.

The apparatus further comprises a packing member disposed at a portion of the filter case, which is contacted with the front opening, and a handle provided at a front face of the filter case.

BRIEF DESCRIPTION OF THE DRAWINGS

The above objects and other advantages of the present invention will become more apparent by describing in detail preferred embodiments thereof with reference to the attached drawings in which.

DETAILED DESCRIPTION OF THE PREFERRED EMBODIMENTS

Figure 1:
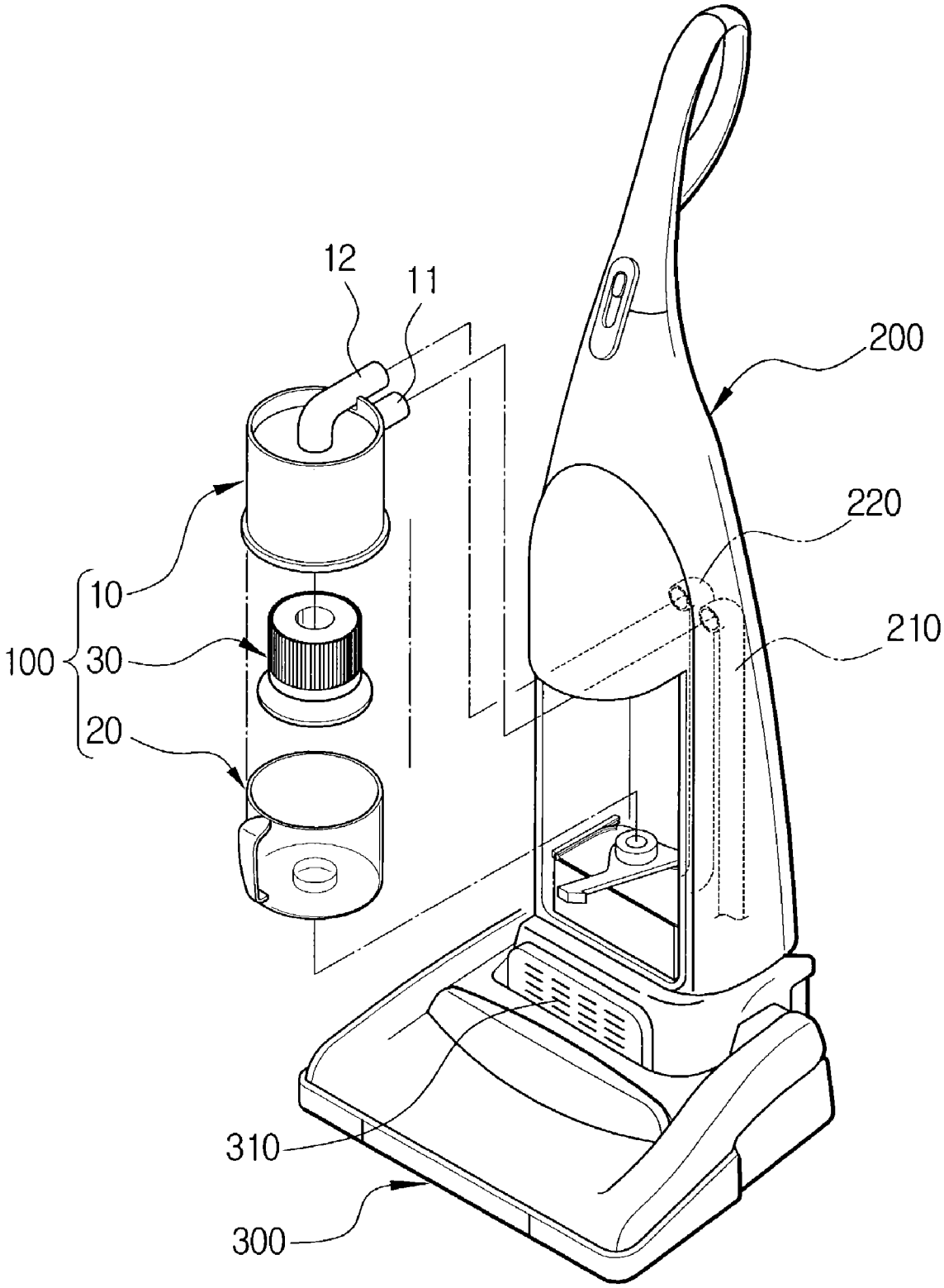
FIG. 1 (PRIOR ART)
FIG. 1 is a perspective view of a conventional cyclone-type dust collecting apparatus and a vacuum cleaner having the cyclone-type dust collecting apparatus.
Figure 2:
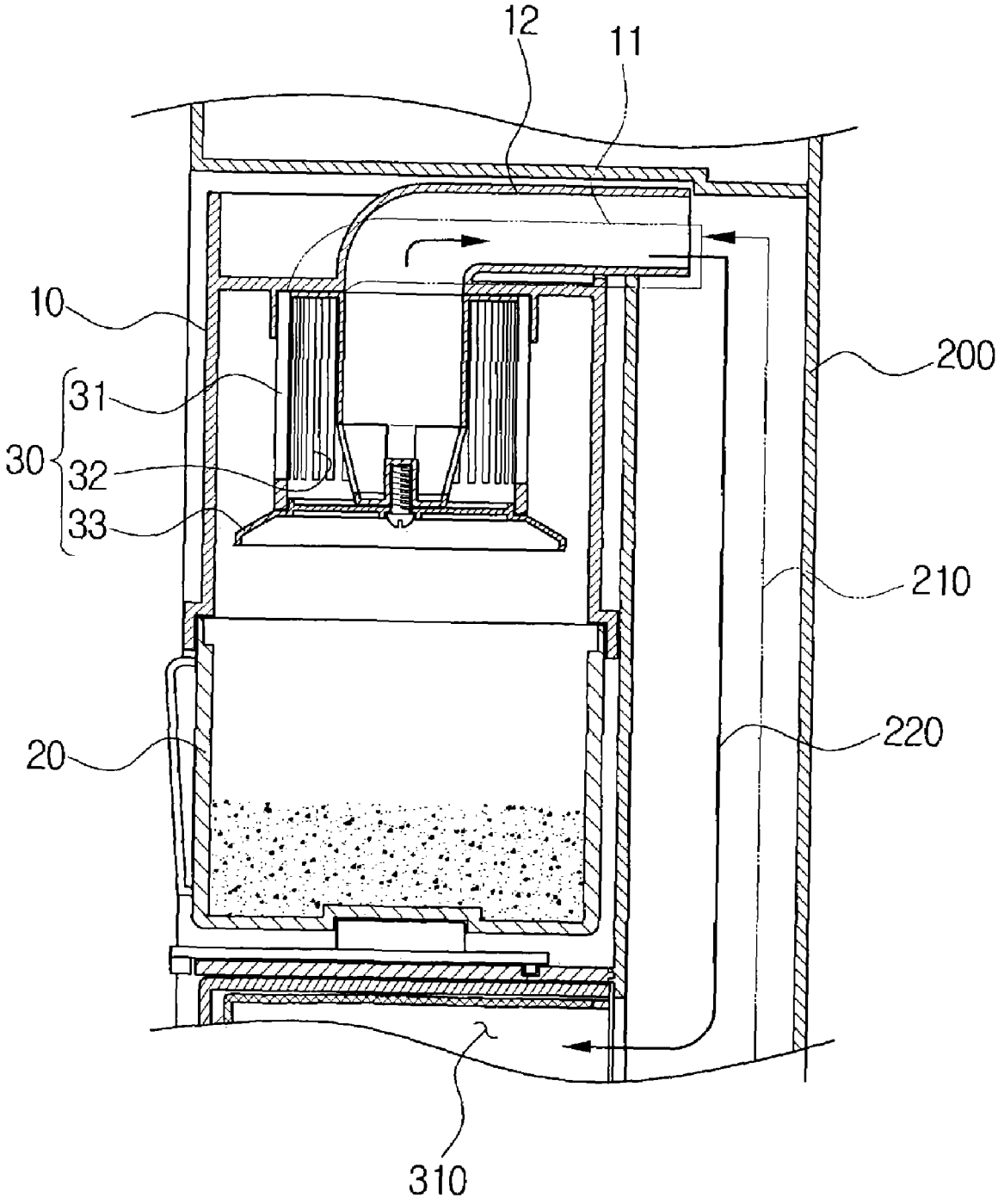
FIG. 2 (PRIOR ART)
FIG. 2 is a cross-sectional view showing a dust separating and collecting process of the conventional cyclone-type dust collecting apparatus of FIG. 1.
Figure 3:
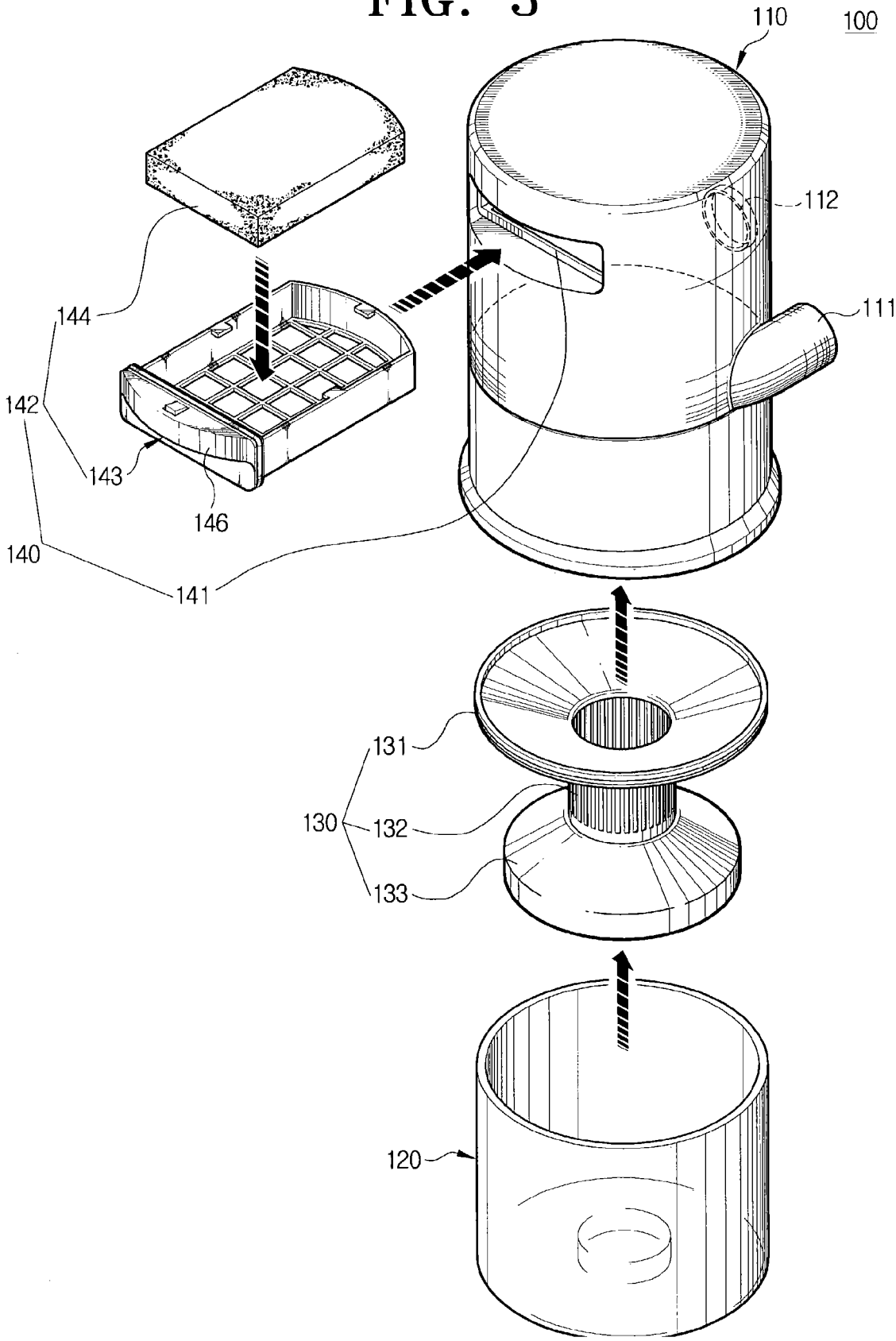
FIG. 3 is an exploded perspective view of a cyclone-type dust collecting apparatus for a vacuum cleaner according to an embodiment of the present invention.
Figure 4:
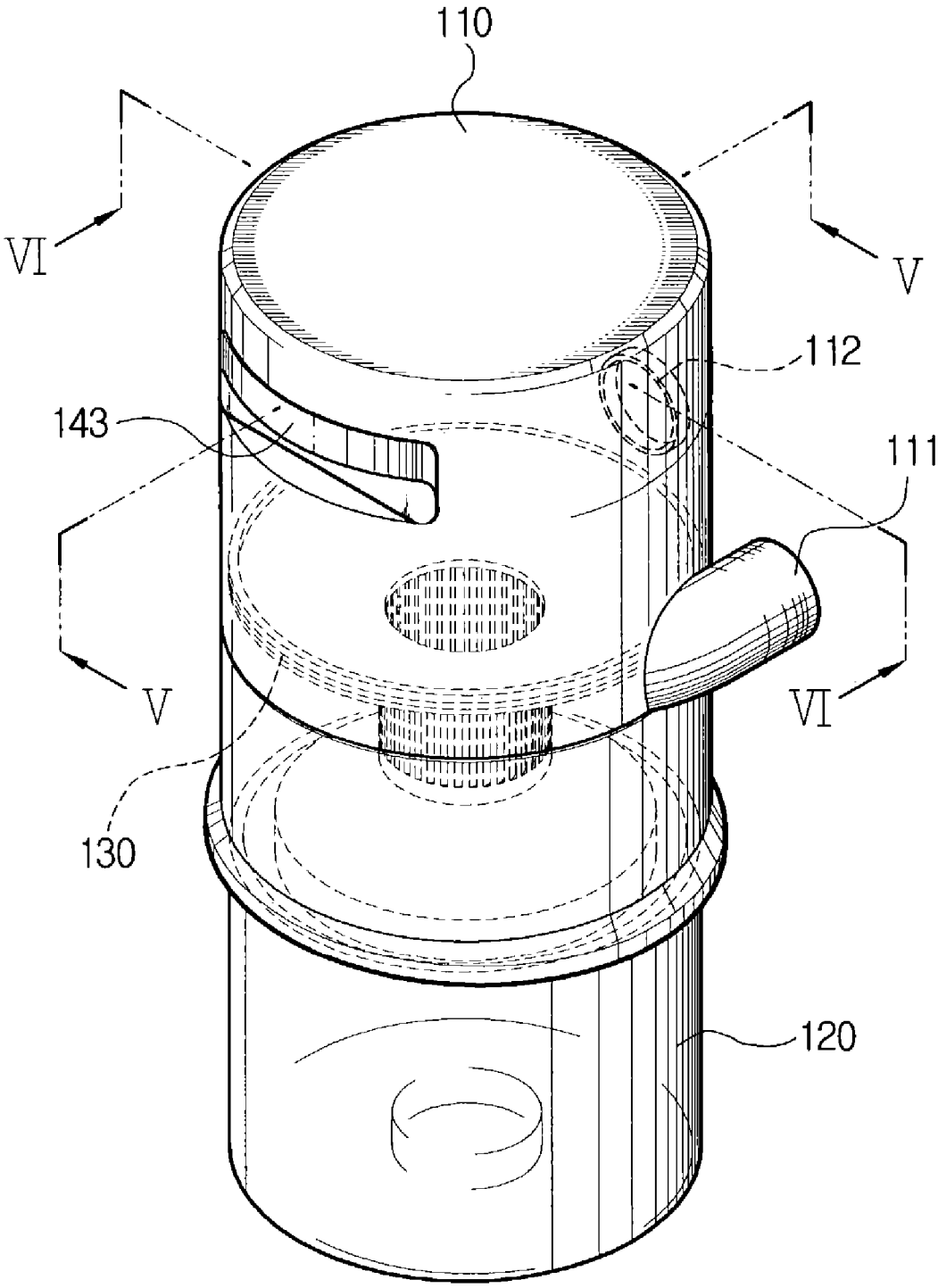
FIG. 4 is a perspective view showing an assembled state of FIG. 3.
Figure 5:
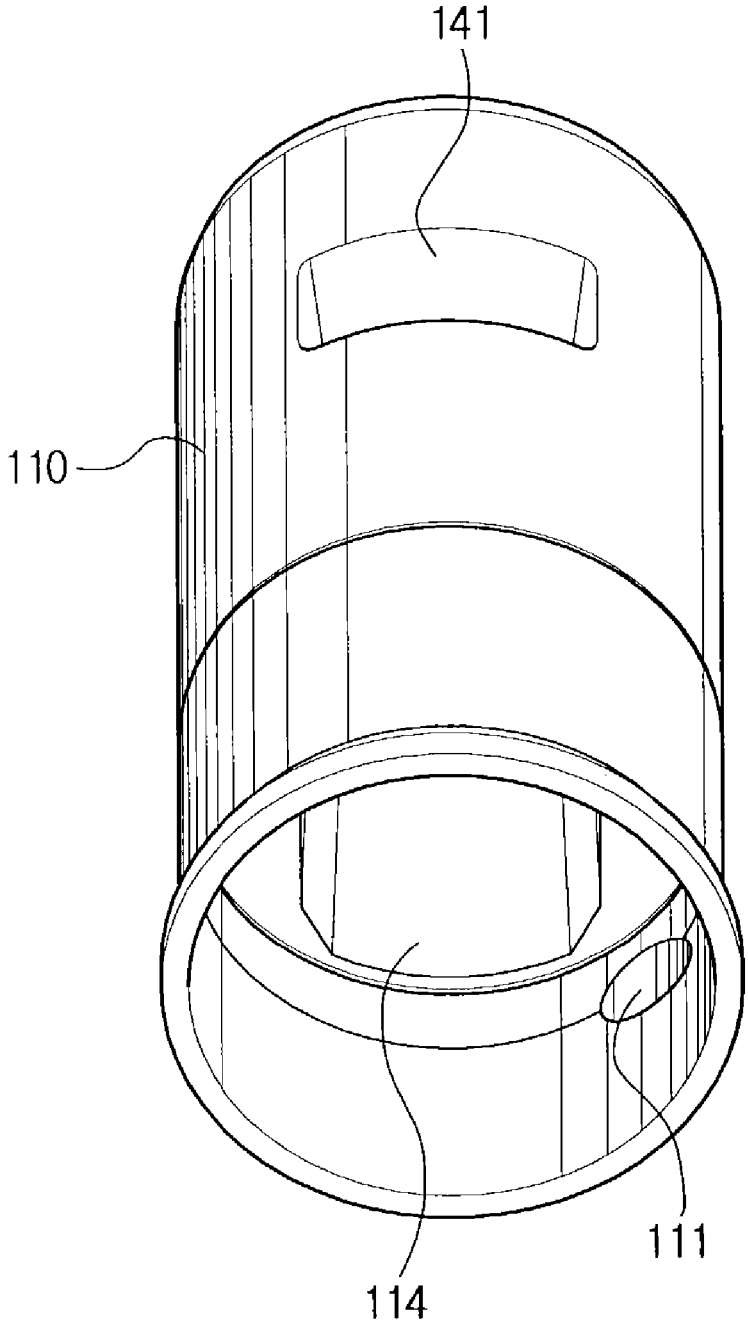
FIG. 5 is a lower perspective view showing a status that a grill is separated from FIG. 4.
Figure 6:
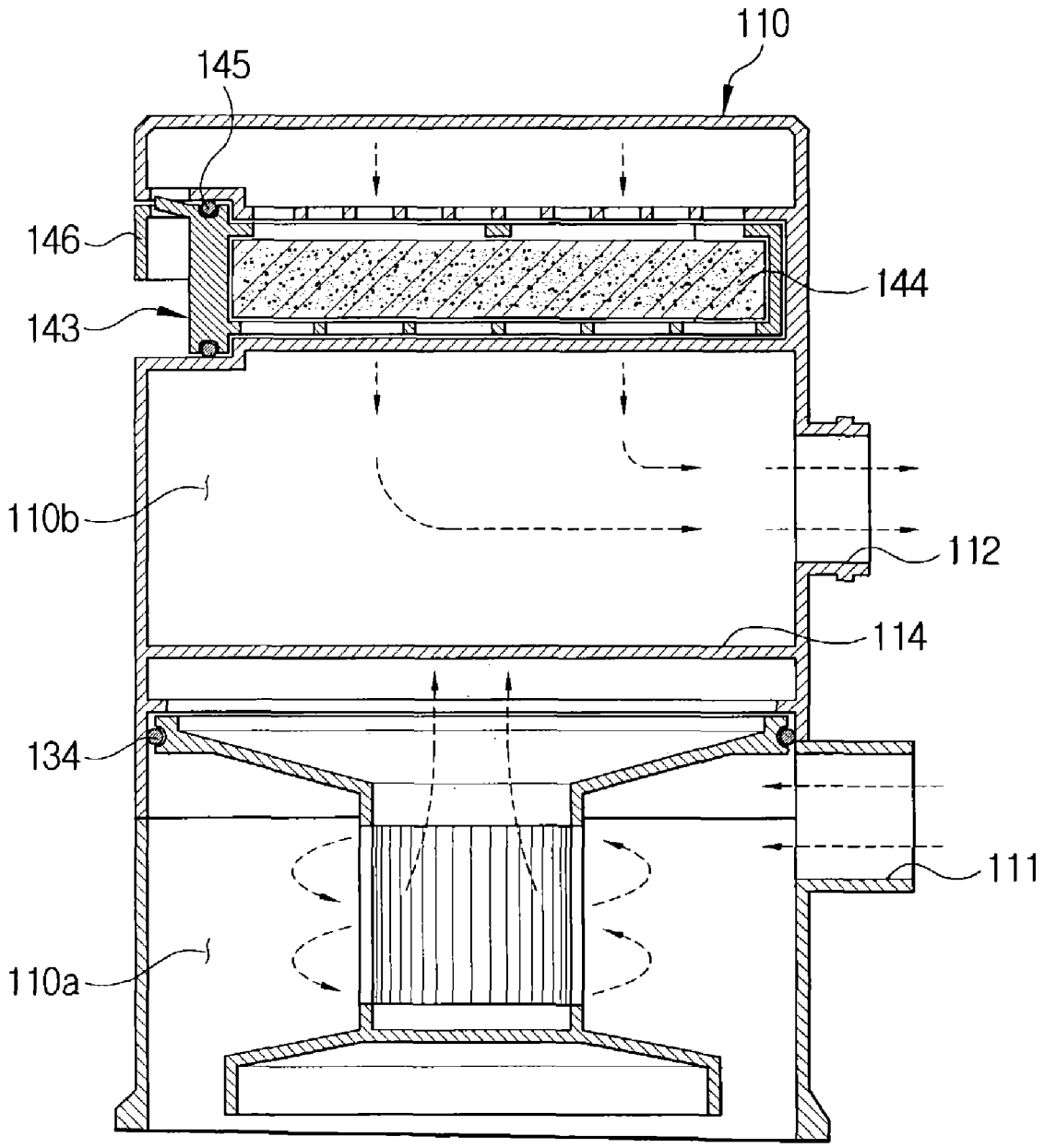
FIG. 6 is a cross-sectional view taken along a line V—V of FIG. 4.
Figure 7:
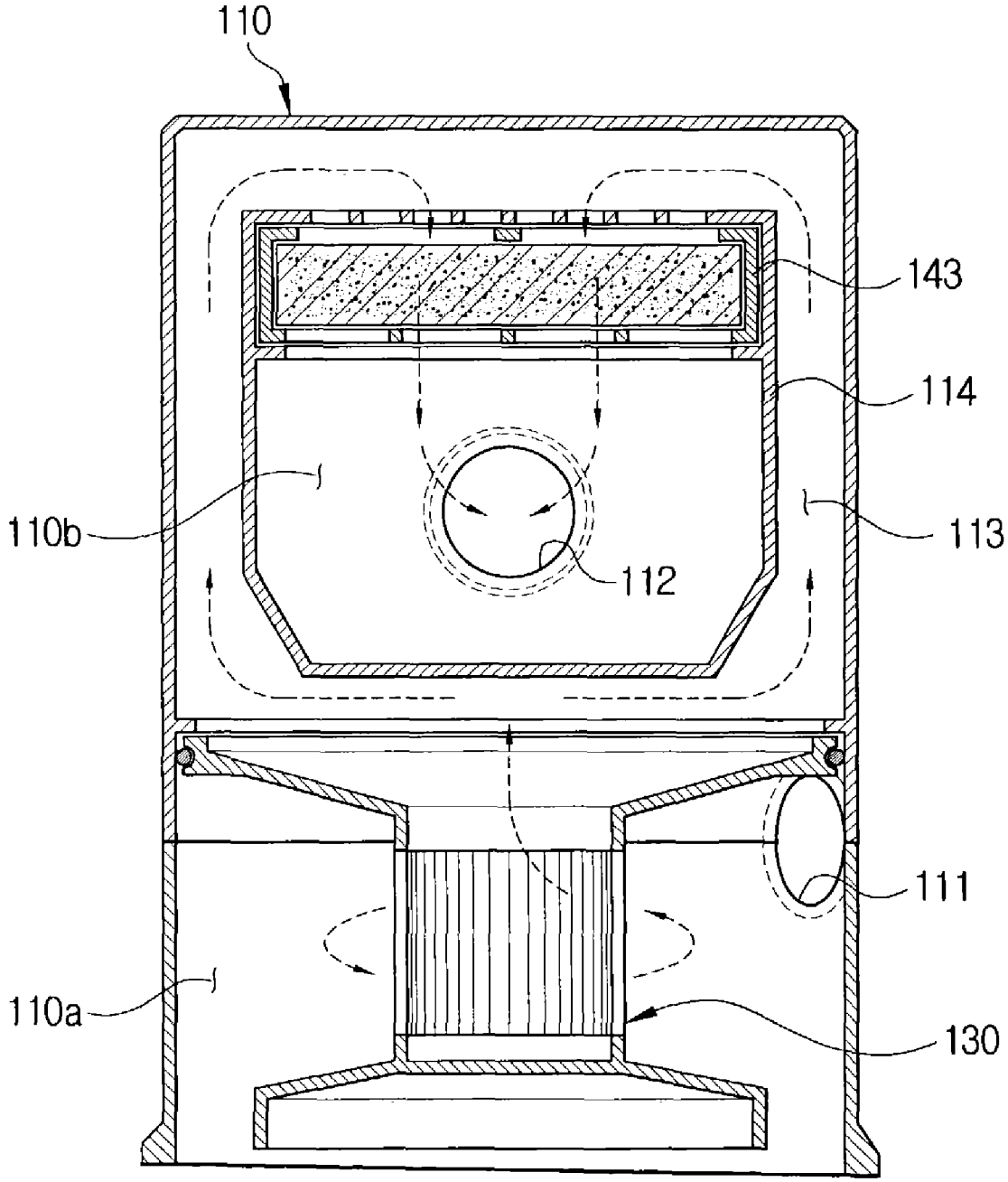
FIG. 7 is a cross-sectional view taken along a line VI—VI of FIG. 4.

Now, preferred embodiments of the present invention will be described in detail with reference to the annexed drawings.

As shown in FIGS. 3 to 7, a cyclone-type dust collecting apparatus 100 for a vacuum cleaner according to an embodiment of the present invention comprises a cyclone body 110, a dust collecting container 120, a grill assembly 130 and a fine dust filtering means 140.

Figure 8:
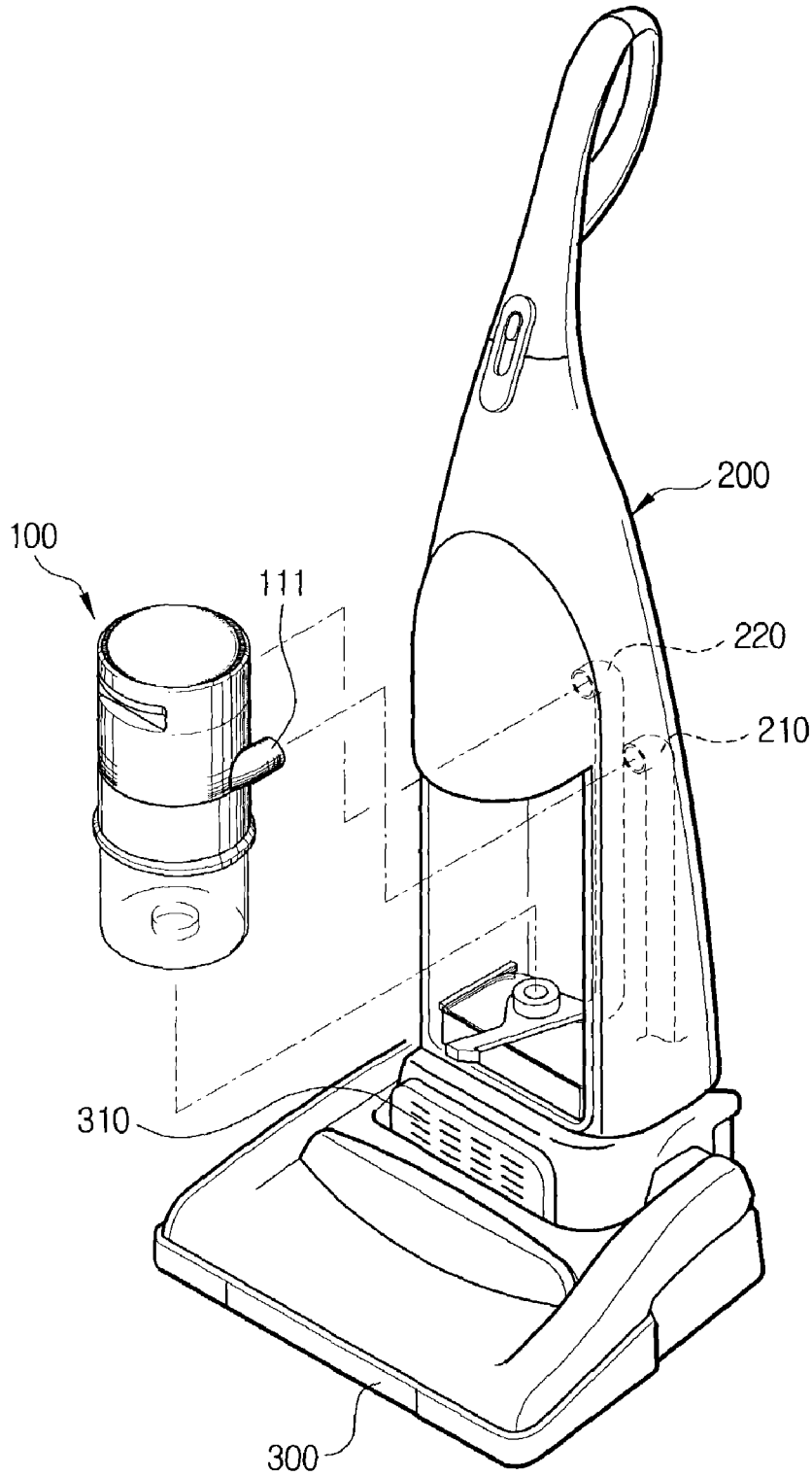
FIG. 8 is a perspective view showing a status that the cyclone-type dust collecting apparatus is mounted in the vacuum cleaner according to an embodiment of the present invention.

The cyclone body 110 is formed to have a cylindrical shape of which an upper side is blocked, and also has a vortex current chamber 110*a* at a lower side thereof and a pressure drop chamber 110*b* at an upper side thereof. The vortex current chamber 110*a* is formed with an air inlet port 11 and the pressure drop chamber 110*b* is formed with an air outlet port 112. The air inlet port 11 is disposed so that air is introduced along an inner surface of the vortex current chamber 110*a* in a tangential direction, and the air outlet port 112 is disposed in the same direction as the air inlet port 111. Herein, as shown in FIG. 8, when the cyclone-type dust collecting apparatus is disposed in a main body of the vacuum cleaner, the air inlet port 111 is connected with an air inlet path 210 which is formed at the main body 200 of the vacuum cleaner to be communicated with a suction brush 300. The air outlet port 112 is connected with an air outlet path 220 which is formed at the main body 200 of the vacuum cleaner to be communicated with a motor driving chamber 310. Therefore, the air introduced through the suction brush 300 and containing dust is introduced through the air inlet path 210 of the main body 200 of the vacuum cleaner and the air inlet port 111 into the cyclone body 110. Then, clean air from which the dust is separated by centrifugal force in the cyclone body 110 is exhausted through the air outlet port 112, the air outlet path 220 of the main body of the vacuum cleaner and the motor driving chamber 310 to the outside.

The dust is removably coupled to a lower side of the cyclone body 110 so as to collect the dust separated by the centrifugal force of a vortex current.

The grill 130 is disposed at an upstream of the air outlet port 112 in the cyclone body 110 so as to prevent a backflow of the dust separated from the air. The grill 130 comprises a grill body 131, a plurality of paths 132 formed at the grill body 131 so as to be communicated with the air outlet port 112 and a dust preventing member 133 disposed at a lower side of the grill body 131. The grill 130 is removably disposed at the cyclone body 110 by a plurality of protrusions (not shown) formed at an outer surface of the grill body 131 and latching grooves (not shown) formed at an inner surface of the vortex current chamber 110*a* of the cyclone body 110 corresponding to the protrusions. Furthermore, at the outer surface of the grill body 131, there is provided a packing member 134 for sealing between the grill body 131 and the inner surface of the vortex current chamber 110*a*.

The fine dust filtering means 140 is disposed at a downstream portion of the grill 130 in the cyclone body 110 so as to filter and collect the fine dust passing through the path 132 of the grill 130. Therefore, it is prevented that the fine dust is flown back together with the air and thus exhausted to the outside, thereby increasing a dust collecting efficiency of the cyclone-type dust collecting apparatus.

The fine dust filtering means 140 is provided with a filter mounting portion 141 and a filter assembly 142. The filter mounting portion 141 is provided at the pressure drop chamber 110*b* of the cyclone body 110 and has a plurality of upper and lower through-holes and a front opening. The filter assembly 142 is disposed at the filter mounting portion 141 to be detached through the front opening in a drawer way, and has a filter case 143 and a fine filter 144. At a portion of the filter case 143, which is contacted with the front opening, there is provided a packing member 145 for sealing. At a front face of the filter case 143, there is provided a handle 146. The fine filter 144 may be formed of sponge, non-woven fabric, etc.

Meanwhile, according to other characteristic of the present invention, at the pressure drop chamber 110*b* of the cyclone body 110, there is provided a path forming member 114 for forming an air outlet guiding path 113 by which the air containing the fine dust passing through the grill 130 is flown from the upstream portion toward the downstream portion of the fine dust filtering means and then exhausted through the air outlet port 112. The filter mounting portion 141 is integrally formed at an upper portion of the path forming member 114.

As shown in FIG. 8, the cyclone-type dust collecting apparatus for the vacuum cleaner according to an embodiment of the present invention is disposed in the main body 200 of the vacuum cleaner so that the air inlet port 111 and the air outlet port 112 of the cyclone body 110 are respectively connected with the air inlet path 210 and the air outlet path 220 of the main body 200 of the vacuum cleaner.

When starting a cleaning operation, a suction force is generated at a suction brush 300 due to driving of a motor in a motor driving chamber 310. Then, the air containing the dust on a surface of an object to be cleaned is introduced through the suction brush 300, the air inlet path 210 and the air inlet port 111 into the vortex current chamber 110*a* of the cyclone body 110 due to the suction force. The dust contained in the air is separated by the centrifugal force of the vortex current in the vortex current chamber 110*a* and then collected in the dust collecting container 120. The air is then introduced through the path 132 of the grill 130 into the pressure drop chamber 110*b* of the cyclone body 110. At this time, the air is flown along the air outlet guiding path 113 provided in both sides of the pressure drop chamber 110*b* by the path forming member 114 as shown by an arrow of FIG. 7, and then flown from the upper portion toward the lower portion of the fine dust filtering means 140, and finally exhausted through the air outlet port 112 to the outside. As described above, the fine dust which is not collected by the grill 130 during the flowing of the air is filtered and collected by the fine filter 144 of the fine dust filtering means 140, and thus only the purified air is exhausted to the outside.

According to the present invention as described above, since the fine dust contained in the air is filtered and collected by the fine filter which is disposed at the downstream of the grill, it is prevented that the fine dust is exhausted together with the air to the outside, thereby increasing the dust collecting and cleaning efficiency of the vacuum cleaner.

Further, since the cyclone-type dust collecting apparatus of the present invention has a structure that the air passes from an upper portion of the fine filter toward a lower portion of the fine filter, thereby facilely removing the fine dust. That is, the fine dust filtering means may have a structure that the air is passes from the lower portion of the fine filter toward the upper portion of the fine filter. In this case, however, since the dust is existed in a lower surface of the fine filter, when disassembling the filter to remove the collected fine dust, the dust may be dropped on a floor, thereby contaminating the floor.

While the present invention has been described in detail, it should be understood that various changes, substitutions and alterations can be made hereto without departing from the spirit and scope of the invention as defined by the appended claims.

What is claimed is:

1. A cyclone-type dust collecting apparatus for a vacuum cleaner, comprising:

a cyclone body having an air inlet port and an air outlet port, for forming a vortex current of air which is introduced through the air inlet port and contains dust;

a dust collecting container removably coupled to the cyclone body so as to collect the dust separated by centrifugal force of the vortex current in the cyclone body;

a grill disposed at an upstream portion of the air outlet port in the cyclone body to prevent dust separated from the air from flowing back through the air outlet port; and a fine dust filtering means disposed at a downstream portion of the grill in the cyclone body to collect fine dust which passes through the grill, wherein the cyclone body comprises a vortex current chamber formed with the air inlet port, a pressure drop chamber formed with the air outlet port, and also a path forming member for forming an air outlet guiding path by which the air containing the fine dust passing through the grill is flown from an upstream portion toward a downstream portion of the fine dust filtering means and then exhausted through the air outlet port.

2. The apparatus of claim 1, wherein the fine dust filtering means comprises a filter mounting portion formed at an upper side of the path forming member and having a front opening and a plurality of upper and lower through holes for communicating the air outlet guiding path and the air outlet port; and a filter assembly detachably coupled to the filter mounting portion in a drawer way.

3. The apparatus of claim 2, wherein the filter assembly comprises a filter case having a shape corresponding to a size and a structure of the filter mounting portion; and a fine filter disposed at the filter case.

4. The apparatus of claim 3, wherein the line filter is formed of sponge.

5. The apparatus of claim 3, further comprising a packing member disposed at a portion of the filter case, which is contacted with the front opening.

6. The apparatus of claim 3, further comprising a handle provided at a front face of the filter case.

* * * * *